US007664420B2

(12) United States Patent
Oominami et al.

(10) Patent No.: US 7,664,420 B2
(45) Date of Patent: Feb. 16, 2010

(54) IMAGE FORMING APPARATUS HAVING MONOCHROME AND COLOR PRINT MODES AND A PLURALITY OF SYSTEM SPEEDS

(75) Inventors: Taiichi Oominami, Chiryu (JP); Seiji Shibata, Toyokawa (JP); Tomiko Imoto, Toyohashi (JP); Hiroyuki Maeda, Toyokawa (JP); Hideki Mekada, Shinshiro (JP); Yuichi Yamamoto, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 376 days.

(21) Appl. No.: 11/277,178

(22) Filed: Mar. 22, 2006

(65) Prior Publication Data

US 2007/0110459 A1 May 17, 2007

(30) Foreign Application Priority Data

Nov. 15, 2005 (JP) ..... 2005-329617

(51) Int. Cl.
*G03G 15/00* (2006.01)

(52) U.S. Cl. ..... 399/85

(58) Field of Classification Search ..... 399/85
See application file for complete search history.

(56) References Cited

U.S. PATENT DOCUMENTS 6,029,023 A * 2/2000 Munemori et al. ..... 399/66
6,865,355 B2 * 3/2005 Burkes et al. ..... 399/85
2003/0164971 A1 * 9/2003 Kidani et al. ..... 358/1.13

FOREIGN PATENT DOCUMENTS

| | | | |
|---|---|---|---|
| JP | 11-34438 | | 2/1999 |
| JP | 11-095577 | A | 4/1999 |
| JP | 2000-259047 | A | 9/2000 |
| JP | 2001301240 | A * | 10/2001 |
| JP | 2003-237189 | | 8/2003 |

OTHER PUBLICATIONS

Notice of Rejection issued in corresponding Jp 2005-329617 dated Feb. 17, 2009 with English Translation.

* cited by examiner

*Primary Examiner*—David M Gray
*Assistant Examiner*—Bryan P Ready
(74) *Attorney, Agent, or Firm*—Buchanan Ingersoll & Rooney PC

(57) ABSTRACT

An image forming apparatus of the present invention includes a first identification section for identifying whether a print target page in a print target document is color or monochrome and its page attribute, a second identification section for identifying a system speed during printing of an immediately preceding page of the print target page, a third identification section for identifying a presence of a subsequent page of the print target page and its page attribute, and a system speed determination section for selecting a print mode in conformity to a monochrome/color discrimination result based on an identification result in the first identification section and determining a system speed of the print target page based on the page attribute identified by the first identification section and identification results in the second and third identification sections.

9 Claims, 5 Drawing Sheets

IMAGE FORMING APPARATUS HAVING MONOCHROME AND COLOR PRINT MODES AND A PLURALITY OF SYSTEM SPEEDS

RELATED APPLICATION

This application is based on Japanese Patent Application No. 2005-329617, the content of which is incorporated herein by reference.

BACKGROUND OF THE INVENTION

The present invention relates to an image forming apparatus such as color copiers and printers.

Conventionally, so-called tandem-type color laser printers have large advantage of being able to process image data including monochrome pages and color pages both at the same print speed because latent image formation and toner image formation are executed independently by each of colors Y (yellow), M (magenta), C (cyan) and K (black). In the case of printing a document including both monochrome and color pages, printing all the pages in a color print mode causes increased load or wear of a color processing section, and therefore it is preferable to switch between a color print mode and a monochrome print mode depending on each page.

However, depending of a mixture rate of color and monochrome pages, the print mode should be switched frequently and a time taken for this switchover increases as a loss time. With respect to determination of the print mode in which the monochrome pages should be printed, various technologies (see e.g., JP 2003-237189 A) aiming at reducing the loss time have conventionally been proposed.

In a paragraph 0049 of JP 2003-237189 A, print speeds for the monochrome mode and for the color mode are varied. However, the print speed is just the "print speed" and not necessarily refers to a system speed. Generally, the print speed is not uniquely determined by the system speed but is largely influenced by other elements such as sheet intervals, and it is known that changing such elements increase the print speed.

In the meanwhile, in the tandem-type image forming apparatus supporting monochrome and color printing, the monochrome print mode which does not need to drive a color processing section can increase the system speed and consequently increase the print speed proportionally because the power consumption of the color processing section can be allotted to other sections. However, in a document including both monochrome and color pages, if the print mode is switched depending on the monochrome/color identification of each page in the document, then the system speed should also be switched accordingly. In switching the system speed, the system speed cannot be changed until the latest sheet leaves a fixing device, and this waiting period is a print stop time during which image forming process cannot be started. In the case where frequency of switchover between monochrome and color pages in the document is high, the print stop time increases cumulatively every time the print mode is switched, and this decreases the printing number per time less than a specified value.

SUMMARY OF THE INVENTION

An object of the present invention is to provide an image forming apparatus, which can optimize switchover of a system speed at the time of monochrome printing by focusing attention on the fact that monochrome pages can be printed at the system speed of a color print mode, decrease loss time generated by change in system speed caused by switchover between monochrome and color print modes, and minimize decrease in printing number per time.

In order to accomplish the object, there is provided, in a first aspect of the present invention, an image forming apparatus performing a monochrome print mode and a color print mode and having a plurality of system speeds, including:

a first identification section for identifying whether a print target page in a print target document is color or monochrome and its page attribute;

a second identification section for identifying a system speed during printing of a page immediately before the print target page;

a third identification section for identifying a presence of a subsequent page of the print target page and its page attribute; and a system speed determination section for selecting a print mode in conformity to a monochrome/color identification result based on an identification result in the first identification section and determining a system speed of the print target page based on the page attribute identified by the first identification section and identification results in the second and third identification sections.

In the image forming apparatus in the first aspect of the present invention, the page attribute may be the type of a sheet medium used for printing the page.

In the image forming apparatus in the first aspect of the present invention, when a monochrome page is printed at a system speed of a color print mode based on determination in the system speed determination section, a setting of a transfer section in the image forming apparatus may be switched from first and second transfer settings for performing the monochrome/color print modes to a third transfer setting.

In the image forming apparatus in the first aspect of the present invention, when a monochrome page is printed at a system speed of a color print mode based on determination in the system speed determination section, a setting of a fixing section in the image forming apparatus may be switched from first and second fixing settings for performing the monochrome/color print modes to a third fixing setting.

In the image forming apparatus in the first aspect of the present invention, there may be further included a buffer for temporarily storing data of a plurality of pages in the print target document transferred in sequence, wherein if all the pages stored in the buffer have an identical page attribute, and a difference in printing time caused by a difference between system speeds of color and monochrome print modes in the same page attribute satisfies a relationship:

$$\text{difference in printing time of one page} \times \text{buffer number} > \text{system speed switchover time} \times 2,$$

in which the buffer number denotes a number of pages temporarily stored in the buffer, then the system speed determination section functions, and if not, printing is executed at a system speed of the color print mode in the same page attribute.

Further in the image forming apparatus in the first aspect of the present invention, the system speed determination section can selectively be used based on decision of a user.

There is provided, in a second aspect of the present invention, an image forming apparatus performing a monochrome print mode and a color print mode and having a plurality of system speeds, including:

a first identification section for identifying whether a print target page in a print target document is color or monochrome;

a second identification section for identifying a system speed during printing of a page immediately before the print target page;

a third identification section for identifying a presence of a subsequent page of the print target page; and a system speed determination section for selecting a print mode in conformity to a monochrome/color discrimination result based on an identification result in the first identification section and determining a system speed of the print target page based on identification results in the second and third identification sections.

In the image forming apparatus according to the second aspect of the present invention, there may be further included a buffer for temporarily storing data of a plurality of pages in the print target document transferred in sequence, wherein if a difference in printing time caused by a difference between system speeds of color and monochrome print modes satisfies a relationship:

difference in printing time of one page×buffer number>system speed switchover time×2, in which the buffer number denotes a number of pages temporarily stored in the buffer, then the system speed determination section functions, and if not, printing is executed at a system speed of the color print mode in the same page attribute.

There is provided, in a third aspect of the present invention, an image forming apparatus performing a monochrome print mode and a color print mode and having a plurality of system speeds, including:

a first identification section for identifying whether a print target page in a print target document is color or monochrome;

a second identification section for identifying a system speed during printing of a page immediately before the print target page;

a third identification section for identifying a presence of a subsequent page of the print target page; and a system speed determination section for selecting a print mode in conformity to a monochrome/color discrimination result based on an identification result in the first identification section and determining a system speed of a first print target page in the print target document based on identification results in the second and third identification sections while determining a system speed of second and subsequent pages based on an identification result in the second determination section.

In the image forming apparatus in the third aspect of the present invention, there may be further included a buffer for temporarily storing data of a plurality of pages in the print target document transferred in sequence, wherein if a difference in printing time caused by a difference between system speeds of color and monochrome print modes satisfies a relationship:

difference in printing time of one page×buffer number>system speed switchover time×1, in which the buffer number denotes a number of pages temporarily stored in the buffer, then the system speed determination section functions, and if not, printing is executed at a system speed of the color print mode in the same page attribute.

There is provided, in a fourth aspect of the present invention, an image forming apparatus performing a monochrome print mode and a color print mode and having a plurality of system speeds, including an identification section for identifying whether a print target document includes both color and monochrome pages, wherein a print mode is selected in conformity to a monochrome/color identification of each page in the print target document, and if all the pages in the print target document are color or the print target document includes both color and monochrome pages, then a system speed of the color page is used as a system speed of a print target page.

According to the image forming apparatus of the present invention, the system speed in the case where the print target page is monochrome is determined in consideration of the continuity of monochrome pages immediately before and after a print target page as well as the presence of special sheets, and this makes it possible to reduce a loss time caused by switchover of the system speeds. When a mixture ratio of monochrome and color pages in a print target document is high, influence of a decreased print speed during monochrome printing executed at the system speed for a color print mode in the image forming apparatus of the present invention is smaller than influence of a print stop time due to a loss time caused by system speed changes, and consequently a period of time till the end of printing of the print target document is rather shortened.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
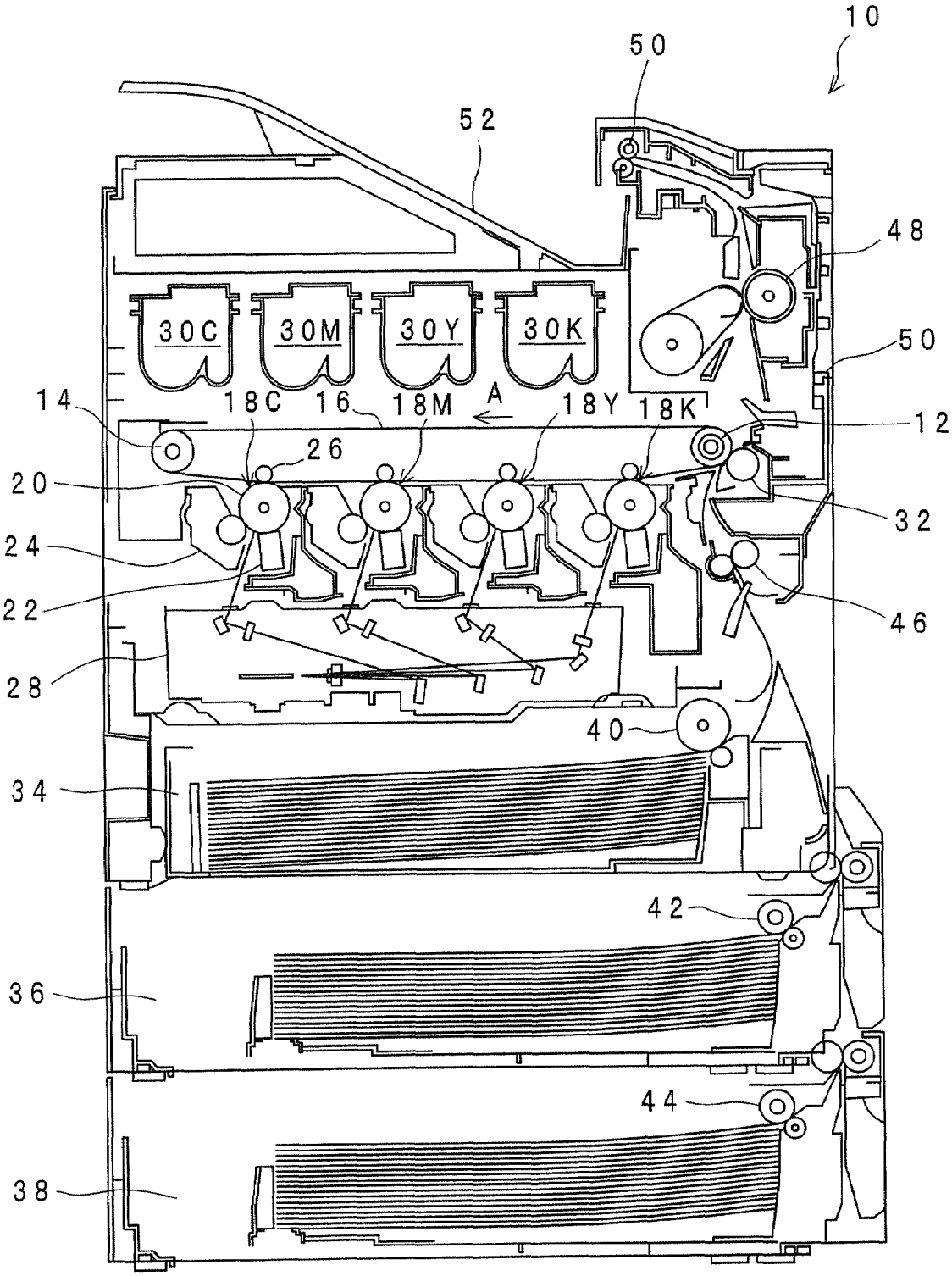
FIG. 1 is an overall structure view showing a color laser printer in a preferred embodiment of the present invention.

FIG. 1 is an overall structure view showing a color laser printer 10 in a most preferred embodiment of the present invention. The printer 10 has an endless film-like intermediate transfer belt 16 which is hung over two rollers 12, 14 disposed parallel at a specified distance and is rotationally driven in an arrow A direction.

Below the intermediate transfer belt 16, image forming units 18C, 18M, 18Y, 18K corresponding to four-color toners C (cyan), M (magenta), Y (yellow) and K (black) are juxtaposed. Since the respective image forming units 18C, 18M, 18Y, 18K share the same structure, their structure is described by taking the image forming unit 18C as an example.

The image forming unit 18C has a dram-like photoreceptor 20 which is rotationally driven in the state of being in contact with the intermediate transfer belt 16. Around the photoreceptor 20, a charging unit 22 for uniformly charging the surface of the photoreceptor 20, a development unit 24 for developing an electrostatic latent image formed on the surface of the photoreceptor 20 with a cyan toner as a toner image, and a primary transfer roller 26 which is in tight contact with the photoreceptor 20 through the intermediate transfer belt 16 for executing primary transfer of the toner image from the photoreceptor 20 to the surface of the intermediate transfer belt 16 with electrostatic force are each disposed. Moreover, below the respective image forming units 18C, 18M, 18Y, 18K, a laser head 28 is disposed. The uniformly charged surfaces of the photoreceptors 20 of the respective image forming units 18C, 18M, 18Y, 18K are exposed to laser light from the laser head 28, by which electrostatic latent images are formed on the photoreceptors 20.

The primary transfer roller 26 of the image forming unit 18K is constantly in tight contact with the photoreceptor 20 through the intermediate transfer belt 16, whereas the respective primary transfer rollers 26 of other image forming units 18C, 18M, 18Y are disposed detachably from the photoreceptors 20. When these primary transfer rollers 26 are detached from the photoreceptors 20, the intermediate transfer belt 16 is released from pressing force of the primary transfer rollers 26, and by the tension of itself, the intermediate transfer belt 16 is separated from the photoreceptor 20 and put in an non-contact state.

Above the intermediate transfer belt 16, four toner cartridges 30C, 30M, 30Y, 30K respectively housing the four toners are juxtaposed. The toners are respectively fed from the respective toner cartridges 30C, 30M, 30Y, 30K to the development units 24 of the respective image forming units 18C, 18M, 18Y, 18K.

A portion of the intermediate transfer belt 16 supported by the roller 12 is in tight contact with a rotatable secondary transfer roller 32. A transfer bias is applied to the secondary transfer roller 32, and a toner image primarily transferred onto the intermediate transfer belt 16 is secondarily transferred onto a sheet such as paper sheets with electrostatic force by the transfer bias.

Below the image forming apparatus 10, three-level paper feeder sections 34, 36, 38 are vertically disposed. The respective paper feeder sections 34, 36, 38 house, for example, a stack of paper sheets different in size and type, and the paper sheets are sent one by one from the upper side by rotationally driving paper feed rollers 40, 42, 44 in a selective way.

The paper sheets sent from the paper feeder section 34, 36, 38 travel through a resist roller 46, a nip section between the intermediate transfer belt 16 and the secondary transfer roller 32 and a fixing unit 48, before being discharged onto a paper discharge tray 52 through a paper discharge roller 50.

Figure 2:
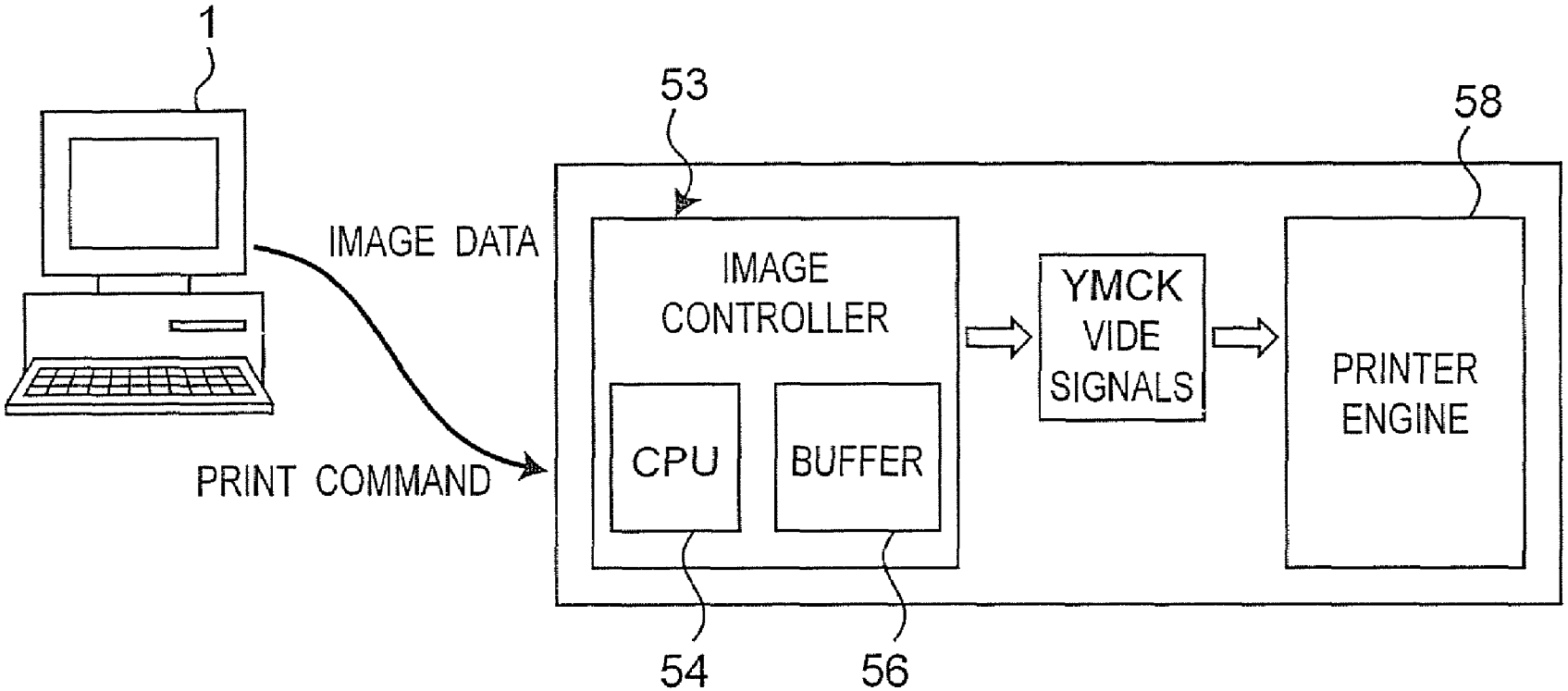
FIG. 2 is a block diagram of an image controller which receives inputs of image data and the like from a computer.

Further, as shown in FIG. 2, the image forming apparatus 10 has an image controller 53. The image controller 53 includes a CPU 54 and a buffer 56. The CPU 54 controls the entire image forming operation including later-described switchover control over print modes and system speeds, and constitutes later-described control-related various identification sections and a system speed determination section. Image data sequentially transferred from an external apparatus 1 such as personal computers to a connection terminal 50 (see FIG. 1) on a lateral face of the printer through, for example, LANs and USB cables is received by an image controller 53. The image data includes bit-mapped data such as characters and images, print commands, color information, sheet type information and the like. In the image controller 53, image data in the print target document is handled per page, and when the image data is composed of a plurality of pages, the image data is temporarily stored in the buffer 56.

Video signals representing YMCK colors produced in the image controller 53 are inputted into the laser head 28 of a printer engine 58. It is to be noted that the term "printer engine 58" is herein used to collectively refer to all the component members relating to printing operation.

Description is now given of the printing operation of the thus-structured printer 10. First, the printing operation in a color print mode will be described.

In the color print mode, in all the image forming units 18C, 18M, 18Y, 18K, the photoreceptors 20 are in contact with the intermediate transfer belt 16. In this state, the surfaces of the photoreceptors 20 in the respective image forming units 18C, 18M, 18Y, 18K are uniformly charged by the charging unit 22, and then the uniformly charged surfaces of the photoreceptors 20 are exposed to laser light from the laser head 28 to form electrostatic latent images, which are developed by the development units 24 as toner images. The four-color toner images each formed in the respective image forming units 18C, 18M, 18Y, 18K are primarily transferred onto the moving intermediate transfer belt 16 in the state of being overlapped in sequence with electrostatic force by the primary transfer roller 26.

The four-color toner image transferred onto the intermediate transfer belt 16 moves to a position facing the secondary transfer roller 32 as the intermediate transfer belt 16 rotates. In synchronization with this movement, a paper sheet fed from any one of the paper feeder section 34, 36, 38 is sent to the nip section between the intermediate transfer belt 16 and the secondary transfer roller 32 by the resist roller 46. By this, the four-color toner image on the intermediate transfer belt 16 is secondarily transferred onto the sheet with electrostatic force by the secondary transfer roller 32.

Thereafter, the sheet on which the four-color toner image has been transferred is transported further upward, and the toner image is fixed by heat when the sheet passes the fixing unit 48 before the sheet is discharged onto the paper discharge tray 52 through the paper discharge roller 50. Thus, the sheet with the color image formed thereon is obtained. It is to be noted that in the color print mode, a transfer bias applied to the secondary transfer roller 32 is set at a second transfer setting, while heating conditions (which are fixing conditions for the fixing unit 48, and more specifically, include fixing temperature for example) of the fixing unit 48 is set at a second fixing setting.

In the monochrome print mode, only the photoreceptor 20 of the image forming unit 18K is in contact with the intermediate transfer belt 16, and in the remaining image forming units 18C, 18M, 18Y, their corresponding primary transfer rollers 26 move upward so that the intermediate transfer belt 16 is in a state away from their photoreceptors 20. In this state, only the image forming unit 18K is driven and in the same process described above, formation of a monochrome image is performed. It is to be noted that in the monochrome print mode, a transfer bias applied to the secondary transfer roller 32 is set at a first transfer setting, while heating conditions of the fixing unit 48 are set at a first fixing setting.

Thus, in the monochrome print mode, by disabling the photoreceptors 20 of the image forming units 18C, 18M, 18Y, which are not related to image formation, from being driven in the state of being not in contact with the intermediate transfer belt 16, wear of the photoreceptor 20 and deterioration of the development units 24 and the toners housed therein can be prevented.

Thus, the color laser printer 10 in the present embodiment performs two print modes, which are a color print mode and a monochrome mode. In the tandem-type color laser printer 10, images can be formed at an identical print speed in both the print modes as long as the system speed is identical.

Since switchover between the color print mode and the monochrome mode is achieved simply by bringing the respective primary transfer rollers 26 of the image forming units 18C, 18M, 18Y into a tight contact with or away from the intermediate transfer belt 16, the switchover can be implemented at relatively high speeds. More specifically, the switchover of the print modes is finished, for example, in approx. 1.5 second.

In the monochrome print mode, driving of the image forming units 18C, 18M, 18Y which are relating to color image formation is stopped, and therefore the power consumption is lower than that in the color print mode. This surplus power can be directed to increase the system speed in the monochrome print mode so that higher print speed can be achieved in the monochrome print.

In order to change the system speed, it is necessary to change the operation speeds in all the sections relating to image formation, which include an operating frequency of the laser head 28, driving speeds of the photoreceptor 20 and the development unit 24 in the image forming unit 18K, a rotational speed of the intermediate transfer belt 16, a driving speed of the fixing unit 48 and a transportation speed of paper sheets. Since changing the system speed changes a contact time of the paper sheets with the intermediate transfer belt 16 and the fixing unit 48, it is also necessary to change the settings of a secondary transfer voltage and a fixing temperature. For switching the system speed, it is necessary to wait for an immediately preceding print sheet in continuous printing to be discharged from the fixing unit 48. Consequently, assuming that the system speed of the color print mode is 152 mm/sec., and the system speed of the monochrome print mode is 185 mm/sec., a time necessary for switching the system speed (hereinbelow arbitrarily referred to as "system speed switchover time") to either print mode takes approx. 5 sec. This is fairly a large value compared to the time necessary for the above-stated print mode switchover (1.5 sec).

Description has been given of the case where the paper sheets used are normal sheets. In the monochrome print mode, printing is available at two system speeds, which are a system speed equal to the speed in the color print mode and a system speed faster in proportion to the surplus power. Moreover, in the case of special sheets such as cardboard sheets and OHP sheets, it is necessary to increase fixity in particular due to their thickness, and therefore the system speed is set at a speed (e.g., 76 mm/sec) almost half the system speed of the normal sheets. This is determined based on the image quality so as to maintain fixity and the like, and so the system speed in this case is identical in both the monochrome and the color print mode.

Upon reception of image data in the image controller 53, the identification whether a print target page is color or monochrome can be determined based on the contents of the page. According to the identification, the image controller 53 determines which print mode to use for printing each page upon reception of the image data. The type and size of a sheet medium can also be identified by the image controller 53 based on a printing command sent together with the image data, and are specified when printing request of the pertinent page is made from the image controller 53 to the printer engine 58.

While the system speed of the printer engine 58 is set based on the sheet information, if the sheet type of the print target page is normal and the page identification is monochrome, then which system speed to use (185 mm/sec or 152 mm/sec) is not determined upon reception of data but is determined immediately before printing of the print target page based on the sheet type and the color/monochrome identification of a subsequent page stored in the buffer 56 and based on the system speed during printing of an immediately preceding page of the print target page. This is because change in system speed takes approx. 5 sec. as described above, and changing the system speed simply based on the color/monochrome identification of each page in the image data possibly generates tremendous loss time.

In order to avoid such tremendous loss time, monochrome pages, if continued to a certain amount, are basically printed at the system speed for color printing. The necessary number of continued monochrome pages N may be determined by calculating an optimum value, or may be determined in consideration of the size of capacity of the buffer 56. Herein, it is assumed that N=5 pages. In the case where the print target page is a normal sheet and a color page, the color print system speed 152 mm/sec. is selected, whereas in the case where that is a special sheet such as cardboard sheet and OHP sheet, the special sheet system speed 76 mm/sec. is selected.

Description is now given of system speed determination processing in the monochrome print mode.

Figure 3:
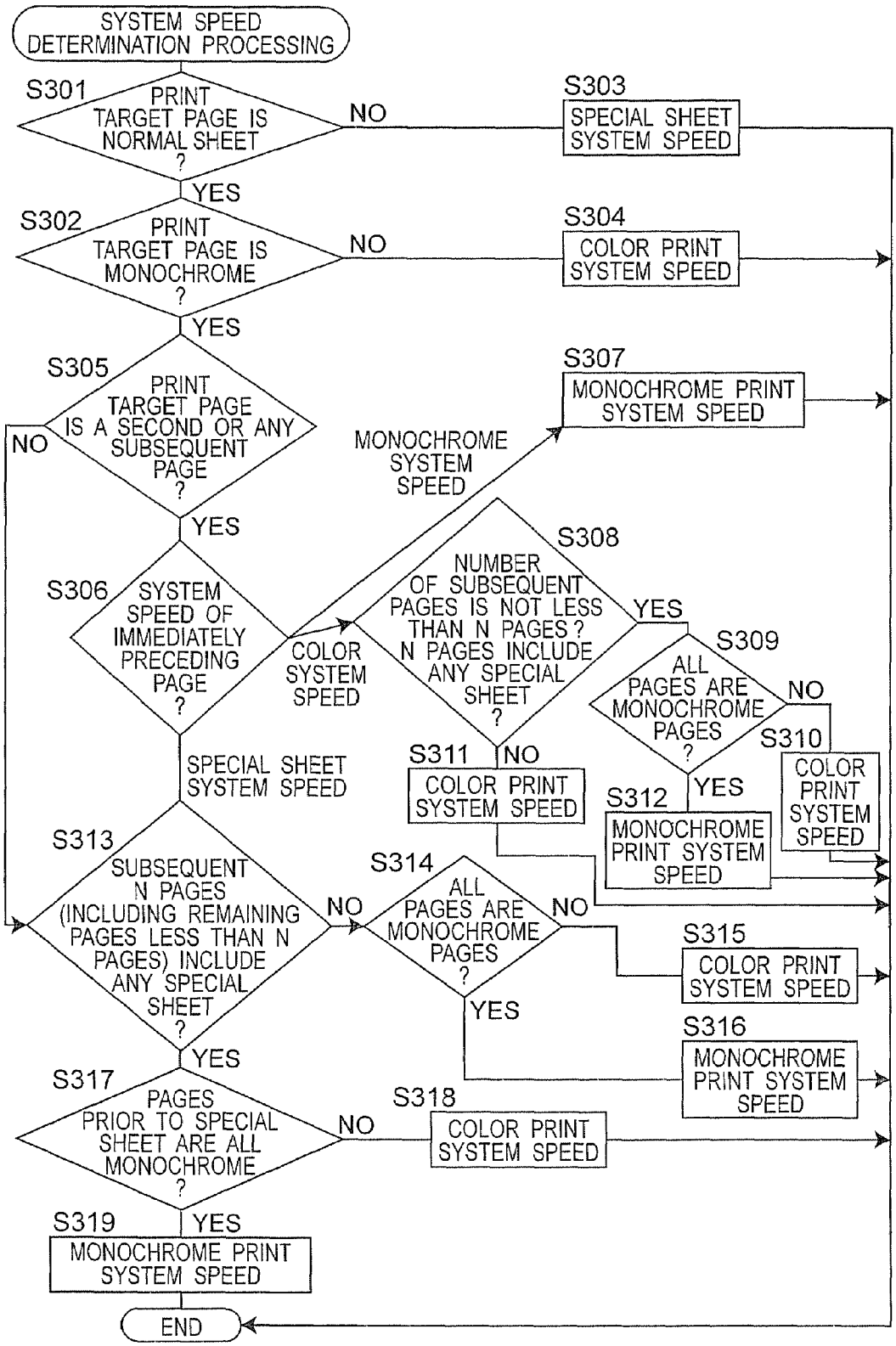
FIG. 3 is a flowchart showing one example of a system speed determination processing.

FIG. 3 shows a flow of system speed determination processing in the monochrome print mode in the color laser printer 10 of the present embodiment. First, in step S301, it is identified whether or not the print target page is a normal sheet. As described above, this can be identified from the sheet type information received together with the image data. If the page is a special sheet, then the special sheet system speed 76 mm/sec is selected in step S303 and the determination processing is ended.

If the print target page is a normal sheet, then the processing proceeds to step S302, where it is identified whether the print target page is monochrome or color. This can also be identified from the received image data of the print target page. If it is a color page, then the color print system speed 152 mm/sec. is selected in step S304. If the print target page is monochrome, then the processing proceeds to step S305, where it is identified whether or not the print target page is a second or any subsequent page. This can be identified by the presence of an immediately preceding page of the print target page in the buffer 56.

If it is a second or any subsequent page, then the processing proceeds to step S306, where a currently used system speed is identified. If it is a monochrome print system speed 185 mm/sec, then the processing proceeds to step S307, where the monochrome print system speed is selected and the determination processing is ended. If the current system speed is a color print system speed 152 mm/sec, then the processing proceeds to step S308, where the state of subsequent pages is identified. Although the number of subsequent pages is herein assumed to be N=5 pages as described above, it is also acceptable to set a value N which satisfies Ts×N>system speed switchover time×2, wherein Ts (sec) is a difference in printing time per one page between the monochrome and color print modes.

Next, in step S308, it is identified that subsequent pages is not less than a determination criterion N=5 pages and these N=5 pages do not include any special sheet. If the number of subsequent pages is less than 5 pages or these 5 pages include any special sheet, then it means that the number of continued monochrome pages does not satisfy the determination criterion for system speed switchover, and therefore the processing proceeds to step S311, where the color print system speed is selected and the determination processing is ended.

In step S308, if the number of the subsequent pages is not less than the determination criterion N=5 pages and these N=5 pages do not include any special sheet, then it is identified in step S309 whether or not the subsequent N=5 pages are all monochrome pages. If they are all monochrome pages, then it means that the continuous conditions of monochrome pages are satisfied, and therefore the processing proceeds to step S312, where the monochrome print system speed is selected, whereas if they include any color page, then the processing proceeds to step S310, where the color print system speed is selected (i.e., the color print system speed remains unchanged).

In the case where the print target page is the first page in the step S305 and in the case where the immediately preceding system speed is the special sheet system speed 76 mm/sec in step S306, it is identified whether or not the subsequent N=5 pages (including remaining pages less than 5 pages) include any special sheet page in step S313. If they do not include any special sheet, then the processing proceeds to step S314, where it is identified whether or not the subsequent N=5 pages are all monochrome pages, and if they include any color page, then the color print system speed is selected in step S315, whereas if they are all monochrome pages, then the monochrome print system speed is selected in step S316.

In the case where they include any special sheet in step S313, it is identified whether or not all the pages prior to the special sheet page are monochrome in step S317. In the case where the print target page is the first page, or in the chase where the system print speed during immediately preceding printing is the special sheet system speed, a loss time by system speed switchover in the next page is almost the same if the next page is printed in the color print system speed or in the monochrome print system speed. Consequently, both in step S313 and S319, either the color print system speed or the monochrome print system speed is selected not based on the number of subsequent continuous monochrome pages but simply based on whether or not any color page is included.

The above-described system speed determination processing allows optimum selection of the system speed for normal sheet monochrome page printing when the print target document includes both monochrome and color pages.

It is to be noted that in the case of printing a monochrome page in the color print system speed, the secondary transfer roller 32 may be set at a third transfer setting different from first and second transfer settings respectively corresponding to the monochrome print mode and the color print mode. Moreover the fixing unit 48 may be set at a third fixing setting different from first and second fixing settings respectively corresponding to the monochrome print mode and the color print mode.

Figure 4:
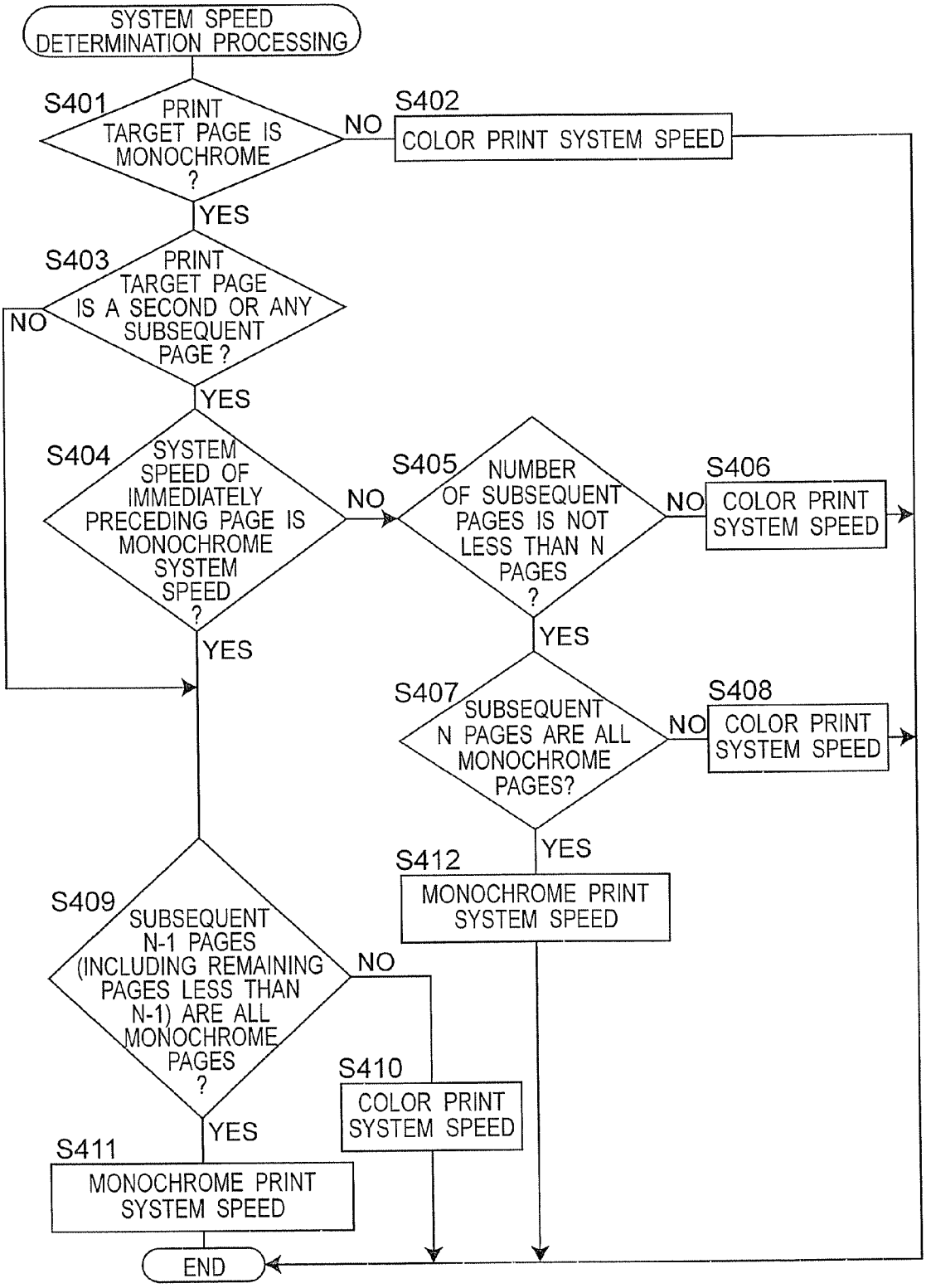
FIG. 4 is a flowchart showing another example of the system speed determination processing.

Description is now given of an example of the system speed determination processing different from the previous one. Although FIG. 3 shows the system speed determination processing in consideration of usage of special sheets as sheet media, only normal sheets are often used as sheet media in actual printing processing. Accordingly, FIG. 4 shows a flow of system speed determination processing in the case of using only normal sheets as sheet media.

First, it is identified whether the print target page is a monochrome page in step S401. If the print target page is a color page, then the processing proceeds to step S402, where the color print system speed is selected and the system speed determination processing is ended.

If the print target page is a monochrome page, then it is identified whether or not the print target page is a second page or any subsequent page in step S403. If it is a second page or any subsequent page, the processing proceeds to step S404, where it is identified whether or not the system speed of an immediately preceding page is the monochrome print system speed. If it is the color print system speed, then the processing proceeds to step S405, where it is identified whether or not the number of subsequent pages is not less than N=5 pages based on data storage in the buffer 56. If the number of subsequent pages is less than N=5 pages, then the color print system speed is selected in step S406 and the determination processing is ended.

If the number of subsequent pages is not less than N=5 pages, then it is identified whether or not the subsequent N=5 pages are all monochrome pages in step S407. In conformity with the result, the monochrome print system speed or the color print system speed is selected in step S412 and S408, and the determination processing is ended.

In the case where the print target page is the first page in step S403 or in the case where the system speed of an immediately preceding page is the monochrome print system speed in step S404, the processing proceeds to step S409, where it is identified whether or not subsequent N−1=4 pages (including subsequent pages less than N−1) are all monochrome pages. If the identification condition in step S409 is met, then the monochrome print system speed is selected in step S411, whereas if the identification condition is not met, the color print system speed is selected in step S410 and the determination processing is ended.

In each example of the system speed determination processing described so far, the system speed during printing of monochrome pages is selected in consideration of the state of subsequent pages. However, In the case where the number of pages in image data is small or in the case where a ratio of color page number in image data is high, once the system speed is slowed, the color print system speed tends to remain unchanged and be continuously applied to the subsequent monochrome pages. In such cases, it is often more realistic in actual printing situations that the printer 10 is operated at the monochrome print system speed only when monochrome pages continue from the first page of image data, and the system speed is changed and maintained to the color print system speed once a color page appears, so that generation of a loss time due to system speed switchover occurs only once.

Figure 5:
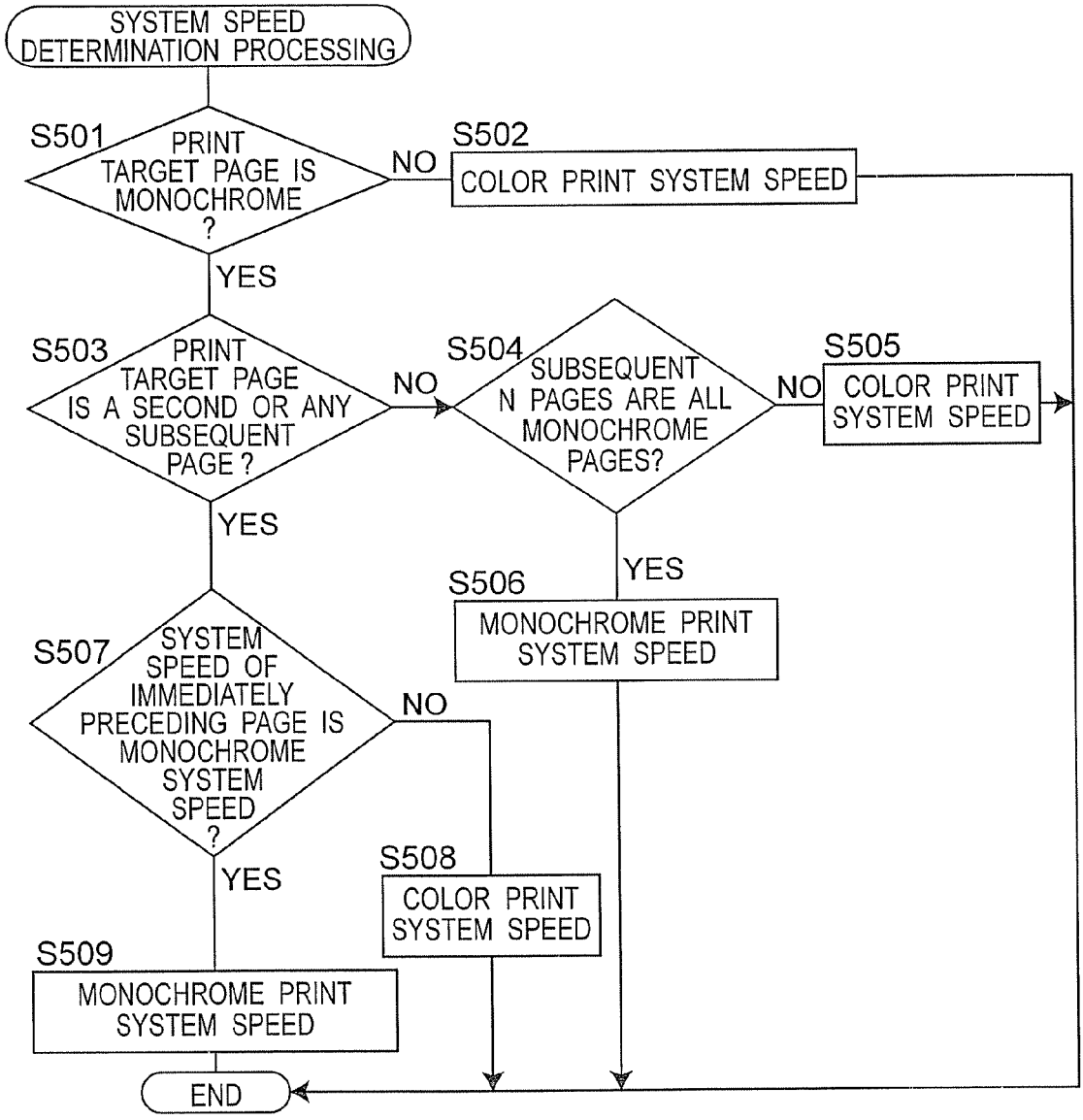
FIG. 5 is a flowchart showing still another example of the system speed determination processing.

A flow of system speed determination processing in the case where system speed switchover is performed only once is shown in FIG. 5. First, it is identified whether or not a print target page is a monochrome page in step S501. If the print target page is a color page, then the processing proceeds to step S502, where the color print system speed is selected and the determination processing is ended.

If the print target page is a monochrome page, then the processing proceeds to step S503, where it is identified whether or not the print target page is a second page or any subsequent page. If the print target page is the first page, then the state of the subsequent pages is identified in step S504. Based on whether or not the subsequent N=5 pages are all monochrome pages, the color print system speed or the monochrome print system speed is selected in step S505, S506, and the determination processing is ended.

Although the number of subsequent pages is assumed to be N=5, it is also acceptable to set a value N which satisfies Ts×N>system speed switchover time×1, wherein Ts (sec) is a difference in printing time per one page between the monochrome and color print modes.

The system speed of the second and subsequent pages is identified only from the system speed set during printing of an immediately preceding page. More particularly, it is identified whether or not the system speed of the immediately preceding page is the monochrome print system speed in step S507, and the color print system speed or the monochrome print system speed is selected in step S508, S509 before the determination processing is ended.

It is to be noted that though description with reference to the drawing is not presented, it is also possible to print all the pages at the color print system speed if the system speed is selectable in a computer 1 and the color print system speed is selected based on decision of a user, or if image data inputted into the image controller 53 is data including both monochrome and color pages. When the number of pages in image data is small or a mixture rate of color pages is high, a loss time incurred in this case only includes a slight difference in comparison with a loss time optimized in the examples of the system speed determination processing described with reference to FIG. 3 or FIG. 5.

According to the printer 10 which executes the thus-described system speed determination processing, it becomes possible to reduce a loss time caused by system speed switchover even when the system speed of monochrome printing is increased in proportion to a surplus portion of power load, and as a result, it becomes possible to decrease a time taken to finish printing of the print target document including both monochrome and color pages.

Description has been given by taking the color laser printer as an example, and however, the present invention is also applicable to color copiers.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus performing a monochrome print mode and a color print mode and having a plurality of system speeds, comprising:

a first identification section for identifying whether a print target page in a print target document is color or monochrome;

a second identification section for identifying a system speed during printing of an immediately preceding page of the print target page;

a third identification section for identifying a presence of a subsequent page of the print target page; and a system speed determination section for selecting a print mode in conformity to a monochrome/color discrimination result based on an identification result in the first identification section and determining a system speed of the print target page based on identification results in the second and third identification sections, wherein when the second identification section identifies that the system speed during printing of an immediately preceding page is a monochrome system speed, then the third identification section determines whether the subsequent page of the print target page is a monochrome page.

2. The image forming apparatus according to claim 1, further comprising a buffer for temporarily storing data of a plurality of pages in the print target document transferred in sequence, wherein if a difference in printing time caused by a difference between system speeds of color and monochrome print modes satisfies a relationship:

difference in printing time of one page×buffer number>system speed switchover time×2, in which the buffer number denotes a number of pages temporarily stored in the buffer, then the system speed determination section functions, and if not, printing is executed at a system speed of the color print mode in the same page attribute.

3. An image forming apparatus performing a monochrome print mode and a color print mode and having a plurality of system speeds, comprising:

a first identification section for identifying whether a print target page in a print target document is color or monochrome;

a second identification section for identifying a system speed during printing of an immediately preceding page of the print target page;

a third identification section for identifying a presence of a subsequent page of the print target page; and a system speed determination section for selecting a print mode in conformity to a monochrome/color discrimination result based on an identification result in the first identification section and determining a system speed of a first print target page in the print target document based on identification results in the second and third identification sections while determining a system speed of second and subsequent pages based on an identification result in the second determination section, wherein when the second identification section identifies that the system speed during printing of an immediately preceding page is a monochrome system speed, then the third identification section determines whether the subsequent page of the print target page is a monochrome page.

4. The image forming apparatus according to claim 3, further comprising a buffer for temporarily storing data of a plurality of pages in the print target document transferred in sequence, wherein if a difference in printing time caused by a difference between system speeds of color and monochrome print modes satisfies a relationship:

difference in printing time of one page×buffer number>system speed switchover time×1, in which the buffer number denotes a number of pages temporarily stored in the buffer, then the system speed determination section functions, and if not, printing is executed at a system speed of the color print mode in the same page attribute.

5. An image forming apparatus performing a monochrome print mode and a color print mode and having a plurality of system speeds, comprising an identification section for identifying whether a print target document includes both color and monochrome pages, wherein when the identification section identifies that a system speed during printing of an immediately preceding page of a print target page in the document is a monochrome system speed, then the identification section determines whether a subsequent page of the print target page is a monochrome page, wherein a print mode is selected in conformity to a monochrome/color identification of each page in the print target document, and if all the pages in the print target document are color or the print target document includes both color and monochrome pages, then a system speed of the color page is used as a system speed of a print target page.

6. The image forming apparatus according to claim 1, wherein when the second identification section identifies that the system speed during printing of an immediately preceding page is a monochrome system speed, then the third identification system determines whether subsequent pages of the print target page are all monochrome pages.

7. The image forming apparatus according to claim 6, wherein when the second identification section identifies that the system speed during printing of an immediately preceding page is a monochrome system speed, then the third identification system determines whether the number of subsequent monochrome pages is less than a predetermined number.

8. The image forming apparatus according to claim 3, wherein when the second identification section identifies that the system speed during printing of an immediately preceding page is a monochrome system speed, then the third identification system determines whether subsequent pages of the print target page are all monochrome pages.

9. The image forming apparatus according to claim 8, wherein when the second identification section identifies that the system speed during printing of an immediately preceding page is a monochrome system speed, then the third identification system determines whether the number of subsequent monochrome pages is less than a predetermined number.

* * * * *

UNITED STATES PATENT AND TRADEMARK OFFICE

CERTIFICATE OF CORRECTION

PATENT NO. : 7,664,420 B2
APPLICATION NO. : 11/277178
DATED : February 16, 2010
INVENTOR(S) : Oominami et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 552 days.

Signed and Sealed this

Thirtieth Day of November, 2010

David J. Kappos

David J. Kappos
*Director of the United States Patent and Trademark Office*